US012703407B2

(12) United States Patent
Emanuel et al.

(10) Patent No.: US 12,703,407 B2
(45) Date of Patent: Aug. 11, 2026

(54) VEHICLES CAPABLE OF OPERATING ON BOTH GROUND AND CANTILEVERED SUPPORT AND TO THEIR TRACKS

(71) Applicant: URBAN.MASS LTD, London (GB)

(72) Inventors: John Emanuel, London (GB); Harpreet Sandhu, London (GB)

(73) Assignee: Urban.Mass Ltd, London (GB)

( * ) Notice: Subject to any disclaimer, the term of this patent is extended or adjusted under 35 U.S.C. 154(b) by 571 days.

(21) Appl. No.: 18/252,418

(22) PCT Filed: Nov. 8, 2021

(86) PCT No.: PCT/EP2021/080982
§ 371 (c)(1),
(2) Date: May 10, 2023

(87) PCT Pub. No.: WO2022/101146
PCT Pub. Date: May 19, 2022

(65) Prior Publication Data

US 2023/0406370 A1 Dec. 21, 2023

(30) Foreign Application Priority Data

Nov. 11, 2020 (GB) ..... 2017791

(51) Int. Cl.
*B61F 9/00* (2006.01)
*B61F 13/00* (2006.01)

(52) U.S. Cl.
CPC ..... *B61F 9/00* (2013.01); *B61F 13/00* (2013.01)

(58) Field of Classification Search
CPC ..... B61F 9/00; B61F 13/00
See application file for complete search history.

(56) References Cited

U.S. PATENT DOCUMENTS 3,780,666 A * 12/1973 Perrott ..... B61B 3/02 105/215.1
3,828,691 A 8/1974 Purath
4,522,128 A 6/1985 Anderson
(Continued)

FOREIGN PATENT DOCUMENTS

| | | |
|---|---|---|
| DE | 3926725 | 2/1991 |
| EP | 0284316 | 9/1988 |
| GB | 2114520 | 8/1983 |

OTHER PUBLICATIONS

PCT Search Report and Written Opinion prepared for PCT Application No. PCT/EP2021/080982, completed Feb. 18, 2022.
(Continued)

*Primary Examiner* — Robert J McCarry, Jr.
(74) *Attorney, Agent, or Firm* — Barnes & Thornburg LLP

(57) ABSTRACT

A vehicle is configured to operate in a first mode in a cantilevered manner from a left side of the vehicle; in a second mode in a cantilevered manner from a right side of the vehicle; and in a third mode in which the vehicle is supported from beneath in a non-cantilevered manner. The vehicle comprises a number of wheel assemblies to facilitate operation in first, second and third modes. The vehicle is configured to navigate between first mode and second mode at junctions offering both options by electing different combinations of wheel engagement and disengagement.

22 Claims, 13 Drawing Sheets

(56) References Cited

U.S. PATENT DOCUMENTS

| | | | |
|---|---|---|---|
| 4,702,173 | A | 10/1987 | Perrott |
| 2009/0301342 | A1 | 12/2009 | Morichika et al. |

OTHER PUBLICATIONS

United Kingdom Examination and Search Report prepared for United Kingdom Patent Application No. GB2017791.1, completed Apr. 19, 2021.
United Kingdom Office Action prepared for United Kingdom Patent Application No. GB2017791.1, completed Mar. 7, 2023.

* cited by examiner

*First mode (left cantilever)*

*Second mode (right cantilever)*

*Third mode (bottom support)*

*Third mode to first mode - left route select*

*Third mode to first mode – right route select*

*Section A-A*
*(from Figure 9)*

*Third mode to third mode - left turn select*

*Third mode to third mode - right turn select*

VEHICLES CAPABLE OF OPERATING ON BOTH GROUND AND CANTILEVERED SUPPORT AND TO THEIR TRACKS

CROSS-REFERENCE TO RELATED APPLICATIONS

This application is the U.S. national phase of PCT/EP2021/080982, filed on Nov. 8, 2021, which claims the benefit of United Kingdom Patent Application Number 2017791.1, filed on Nov. 11, 2020, the entire disclosures of both of which are hereby incorporated by reference herein.

TECHNICAL FIELD

The disclosure relates to vehicles capable of running on ground level tracks at grade or in tunnel, and also cantilevered from the side of an elevated structure.

BACKGROUND

Transportation systems for people or goods by vehicles, capable of running on ground level tracks at grade or in tunnel, and also cantilevered from the side of an elevated structure, have been proposed for a number of years. A significant problem for such transportation systems has been the arrangement of junctions. Junctions are needed for any transportation system other than a simple shuttle from A to B and back again. A number of solutions have been proposed but not adopted, including moving members on the tracks and multiple additional track selection wheels on the vehicles.

SUMMARY OF THE DISCLOSURE

Against this background, there is provided a vehicle configured to operate in a first mode in a cantilevered manner from a left side of the vehicle; in a second mode in a cantilevered manner from a right side of the vehicle; and in a third mode in which the vehicle is supported from beneath in a non-cantilevered manner, the vehicle comprising:

a left lower support wheel on the left side of the vehicle configured to engage with a left lower running surface beneath the left lower support wheel for supporting the vehicle from beneath;

a right lower support wheel on the right side of the vehicle configured to engage with a right lower running surface beneath the right lower support wheel for supporting the vehicle from beneath;

a left upper cantilever wheel assembly on the left side of the vehicle having: an engaged position wherein it is configured to bear against a left upper guide surface located proximate the left side of the vehicle; and a retracted position for disengagement from the left upper guide surface;

a right upper cantilever wheel assembly on the right side of the vehicle having: an engaged position wherein it is configured to bear against a right upper guide surface located proximate the right side of the vehicle; and a retracted position for disengagement from the right upper guide surface;

a left lower cantilever wheel assembly on the left side of the vehicle having: an engaged position wherein it is configured to bear against a left lower guide surface located proximate the left side of the vehicle; and a retracted position for disengagement from the left lower guide surface;

a right lower cantilever wheel assembly on the right side of the vehicle having: an engaged position wherein it is configured to bear against a right side lower guide surface located proximate the right side of the vehicle; and a retracted position for disengagement from the right lower guide surface;

wherein on operation of the vehicle in the first mode: the left lower support wheel is configured to engage with the left lower running surface; the left upper cantilever wheel assembly is in its engaged position; and the left lower cantilever wheel assembly is in its engaged position;

wherein on operation of the vehicle in the second mode: the right lower support wheel is configured to engage with the right lower running surface; the right upper cantilever wheel assembly is in its engaged position; and the right lower cantilever wheel assembly is in its engaged position;

wherein on operation of the vehicle in the third mode: the left lower support wheel is configured to engage with the left lower running surface; the right lower support wheel is configured to engage with the right lower running surface; the left lower cantilever wheel assembly is in its engaged position; and the right lower cantilever wheel assembly is in its engaged position;

whereby, in the third mode, at a junction providing both first and second mode route options, selection between a left route option having a left upper guide surface and a right route option having a right upper guide surface is effected:

(a) for left route selection, by adopting: the engaged position of the left upper cantilever wheel assembly; the engaged position of the left lower cantilever wheel assembly; the disengaged position of the right upper cantilever wheel assembly; and (b) for right route selection, by adopting: the engaged position of the right upper cantilever wheel assembly; the engaged position of the right lower cantilever wheel assembly; the disengaged position of the left upper cantilever wheel assembly.

In this way, no moving parts are required on the track to effect route selection in the third mode at a junction providing both first and second mode route options. The only moving parts are on the vehicle. Moreover, no additional wheels are required for the purpose of track selection. All the wheels are required for support or cantilever guidance in at least one mode. Route selection is facilitated by the choice of wheel deployment.

In some embodiments, in the third mode, at a junction providing both a left route third mode option and a right route third mode option, selection by the vehicle between the left route option and the right route option is effected:

(i) for left route selection by adopting: the engaged position of the right lower cantilever wheel assembly; and the disengaged position of the left lower cantilever wheel assembly; and (ii) for right route selection by adopting: the engaged position of the left lower cantilever wheel assembly; and the disengaged position of the right lower cantilever wheel assembly.

In this way, no moving parts are required on the track to effect route selection in the third mode at a junction providing both left and right third mode options. Again, the only moving parts are on the vehicle. Moreover, no additional wheels are required for the purpose of track selection. All the wheels are required for support or cantilever guidance in at least one mode. Route selection is facilitated by the choice of wheel deployment.

BRIEF DESCRIPTION OF THE DRAWINGS

Embodiments of the disclosure are now provided with reference to the accompanying drawings, in which.

DETAILED DESCRIPTION

Vehicles designed to run at both ground level 'bottom support' and cantilevered from the side of a structure 'side support' require guide wheels, or equivalent means, acting on a suitable guide surface, to keep the vehicle positioned on its track when operating on bottom support, and to counter the moment exerted by the mass of the vehicle when travelling on side support. Such guide wheels may be rubber-tyred and such equivalent means may be a flange on a steel wheel, or a hard-wearing, low-friction, means such as a magnetic counter-force or an air pressure cushion.

In a first mode, the vehicle is cantilevered from a left side, in a second mode the vehicle is cantilevered from a right side and in a third mode the vehicle is supported from beneath without being cantilevered.

Figure 1:
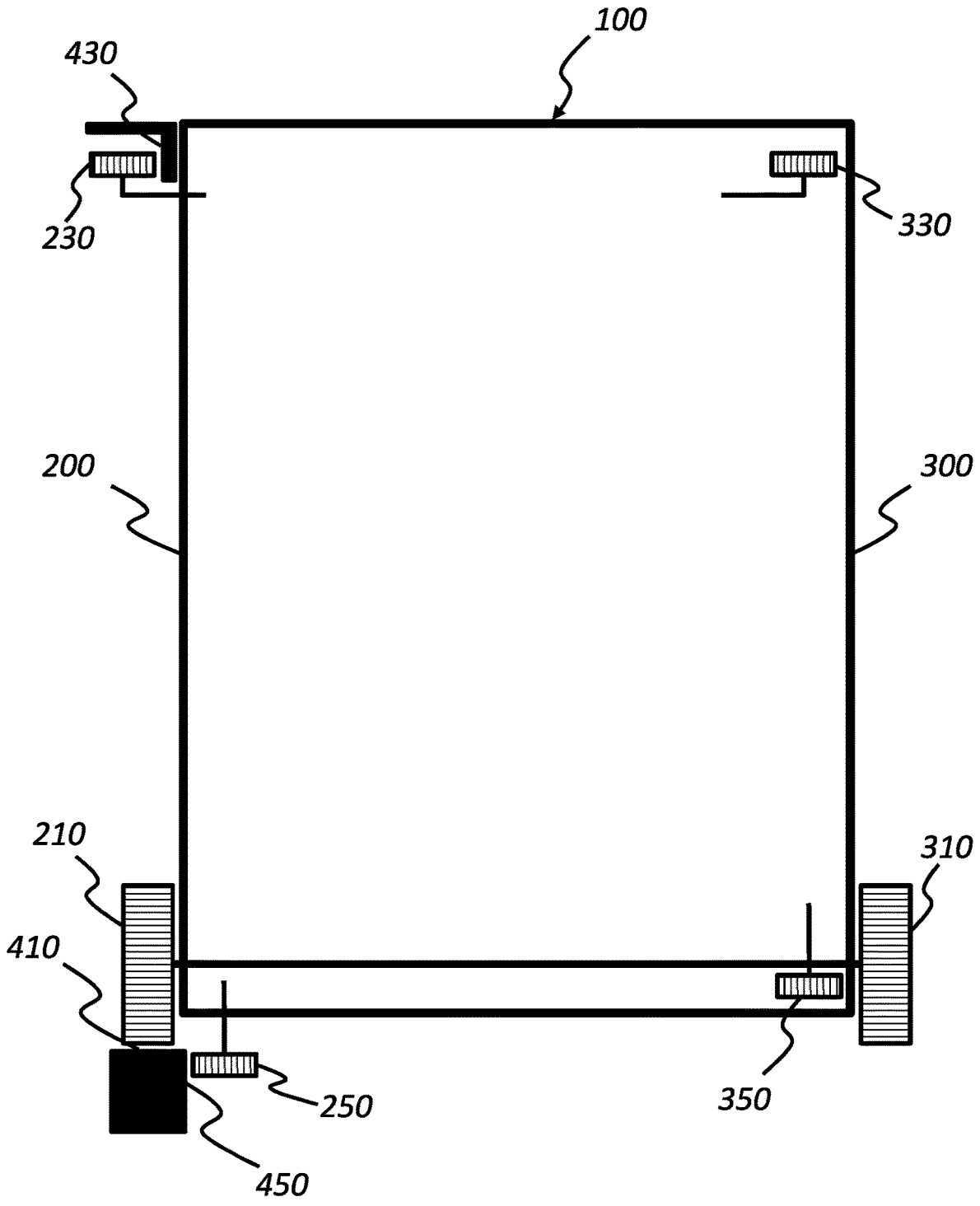
FIG. 1 shows a schematic view of a vehicle in accordance with the disclosure when operating in a first mode, whereby it is cantilevered from the left side.
Figure 2:
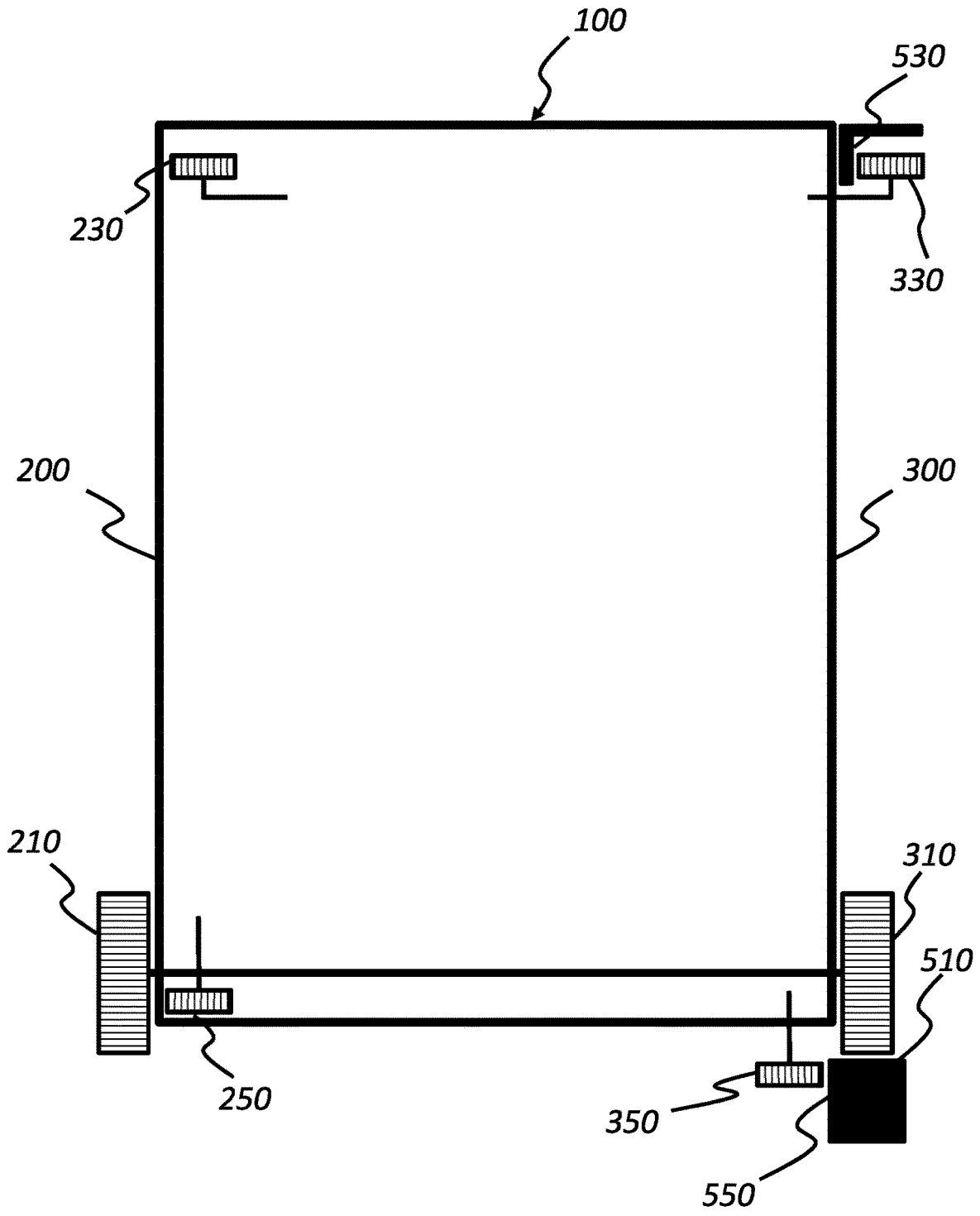
FIG. 2 shows a schematic view of the vehicle of FIG. 1 when operating in a second mode, whereby it cantilevered from the right side.

FIG. 1 shows the vehicle operating in the first mode; FIG. 2 shows the vehicle operating in the second mode; and FIG. 3 shows the vehicle operating in the third mode.

Figure 3:
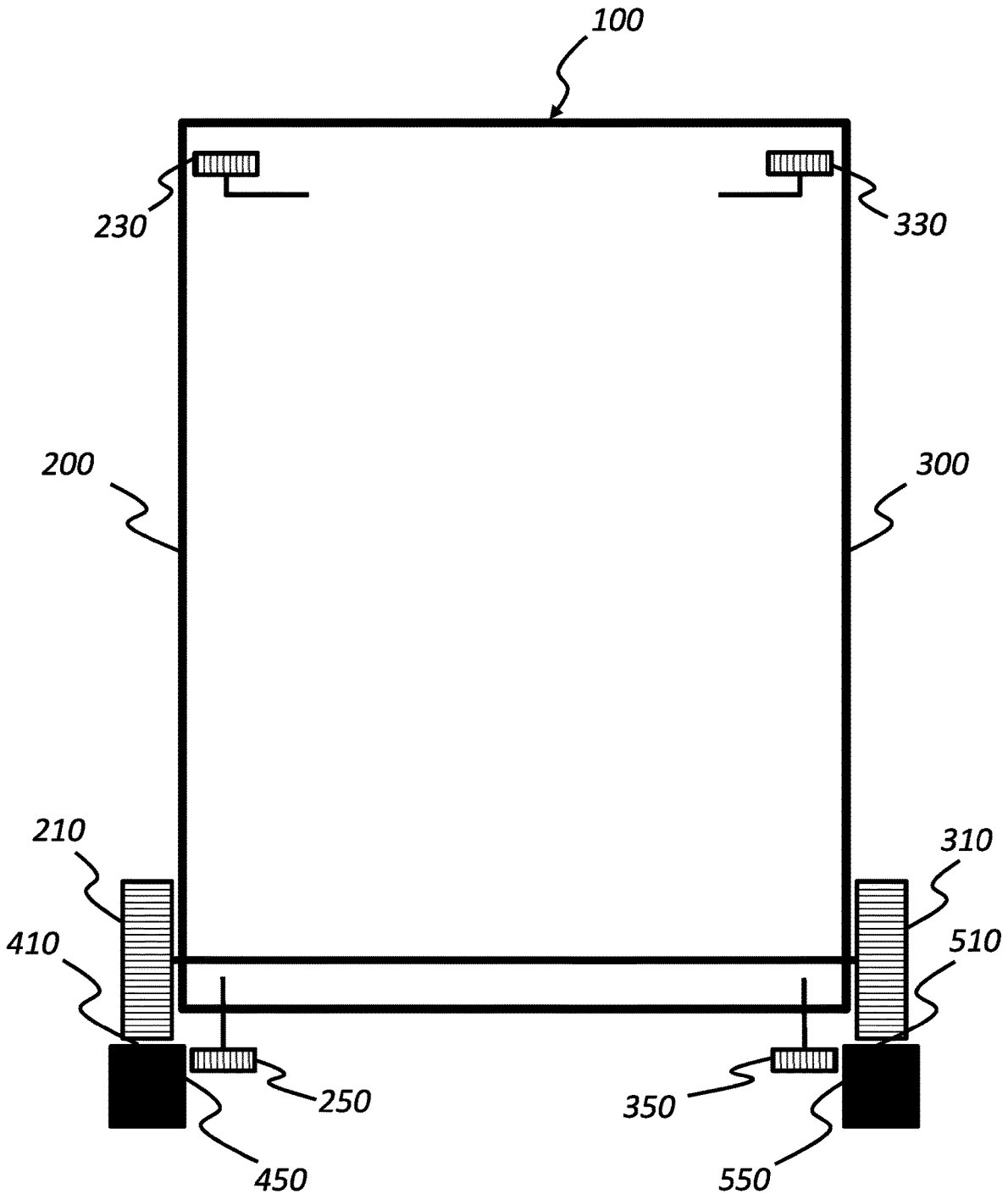
FIG. 3 shows a schematic view of the vehicle of FIGS. 1 and 2 when operating in a third mode, whereby is supported from beneath without being cantilevered.

Referring to FIGS. 1 to 3, a vehicle 100 in accordance with the disclosure comprises a left lower support wheel 210 on the left side 200 of the vehicle 100 and a right lower support wheel 310 on the right side of the vehicle. In many embodiments, there may be a plurality of left lower support wheels 210 and a plurality of right lower support wheels 310.

The left lower support wheel 210 is configured to engage with a left lower running surface 410 beneath the left lower support wheel 210 for supporting the vehicle 100 from beneath and the right lower support wheel 310 is configured to engage with a right lower running surface 510 beneath the right lower support wheel 310 for supporting the vehicle 100 from beneath. The left and right lower running surfaces 410, 510 may be substantially horizontal.

The vehicle 100 also comprises a left upper cantilever wheel assembly 230 on the left side of the vehicle 100 and a right upper cantilever wheel assembly 330 on the right side 300 of the vehicle 100. In many embodiments, there may be a plurality of left upper cantilever wheel assemblies 230 and a plurality of right upper cantilever wheel assemblies 330.

The term "wheel assembly" is used throughout this document to refer to an assembly comprising a mounting and a wheel rotatably mounted to the mounting. Wheel assembly components are described further below with reference to FIG. 11.

The vehicle 100 also comprises a left lower cantilever wheel assembly 250 on the left side 200 of the vehicle 100 and a right lower cantilever wheel assembly 350 on the right side 300 of the vehicle 100. In many embodiments, there may be a plurality of lower cantilever wheel assemblies 250 and a plurality of right lower cantilever wheel assemblies 350.

The left upper cantilever wheel assembly 230 has: an engaged position wherein it is configured to bear against a left upper guide surface 430 located proximate the left side 200 of the vehicle 100; and a retracted position for disengagement from the left upper guide surface 430. Similarly, the right upper cantilever wheel assembly 330 has: an engaged position wherein it is configured to bear against a right upper guide surface 530 located proximate the right side 300 of the vehicle 100; and a retracted position for disengagement from the right upper guide surface 530.

The left and right upper guide surfaces 430, 530 may be substantially vertical.

The left lower cantilever wheel assembly 250 has: an engaged position wherein it is configured to bear against a left lower guide surface 450 located proximate the left side 200 of the vehicle 100; and a retracted position for disengagement from the left lower guide surface 450. Similarly, the right lower cantilever wheel assembly 350 has: an engaged position wherein it is configured to bear against a right lower guide surface 550 located proximate the right side 300 of the vehicle 100; and a retracted position for disengagement from the right lower guide surface 550.

The left and right lower guide surfaces 450, 550 may be substantially vertical.

In the first mode, as shown in FIG. 1, both the left upper cantilever wheel assembly 230 and the left lower cantilever wheel assembly 250 are in the engaged position and both the right upper cantilever wheel assembly 330 and the right lower cantilever wheel assembly 350 are in the retracted position.

In the second mode, as shown in FIG. 2, both the right upper cantilever wheel assembly 330 and the right lower cantilever wheel assembly 350 are in the engaged position and both the left upper cantilever wheel assembly 230 and the left lower cantilever wheel assembly 250 are in the retracted position.

In the third mode, as shown in FIG. 3, both left and right lower support wheels 210, 310 are supported by respective left and right lower running surfaces 410, 510 simultaneously. In addition, the left lower cantilever wheel assembly 250 and the right lower cantilever wheel assembly 350 are in their engaged positions.

By providing engagable and retractable upper and lower cantilever wheel assemblies on both sides of the vehicle, it is possible to deploy the engagable and retractable functionality of the wheel assemblies in order to effect route selection at a junction without requiring moving parts at the junction. This will be explained further below after an introduction to the track system.

Figure 4:
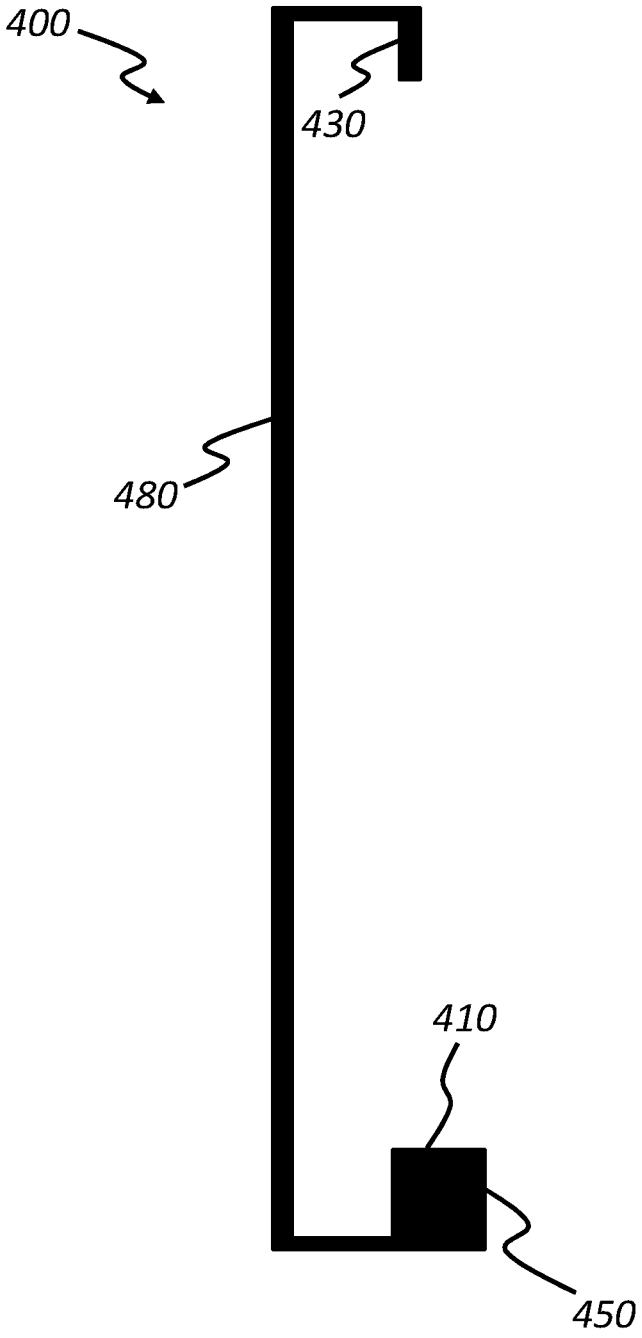
FIG. 4 shows a schematic view of a part of a track system in accordance with the disclosure configured for left side cantilever running.
Figure 5:
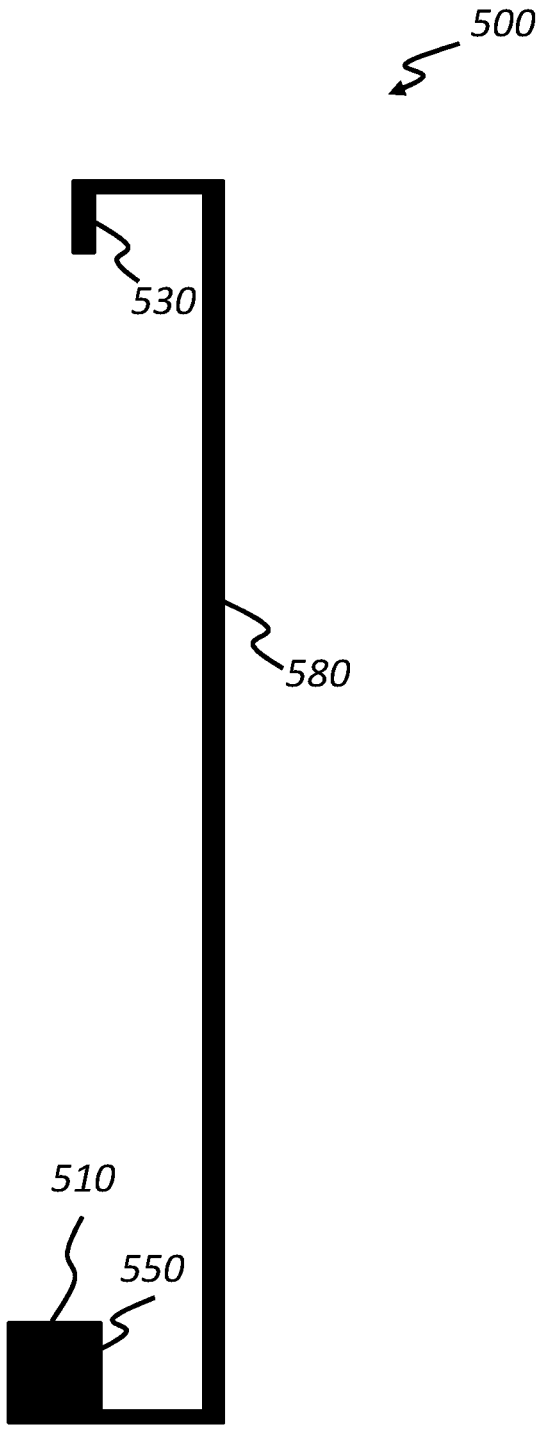
FIG. 5 shows a schematic view of a part of a track system in accordance with the disclosure configured for right side cantilever running.
Figure 6:
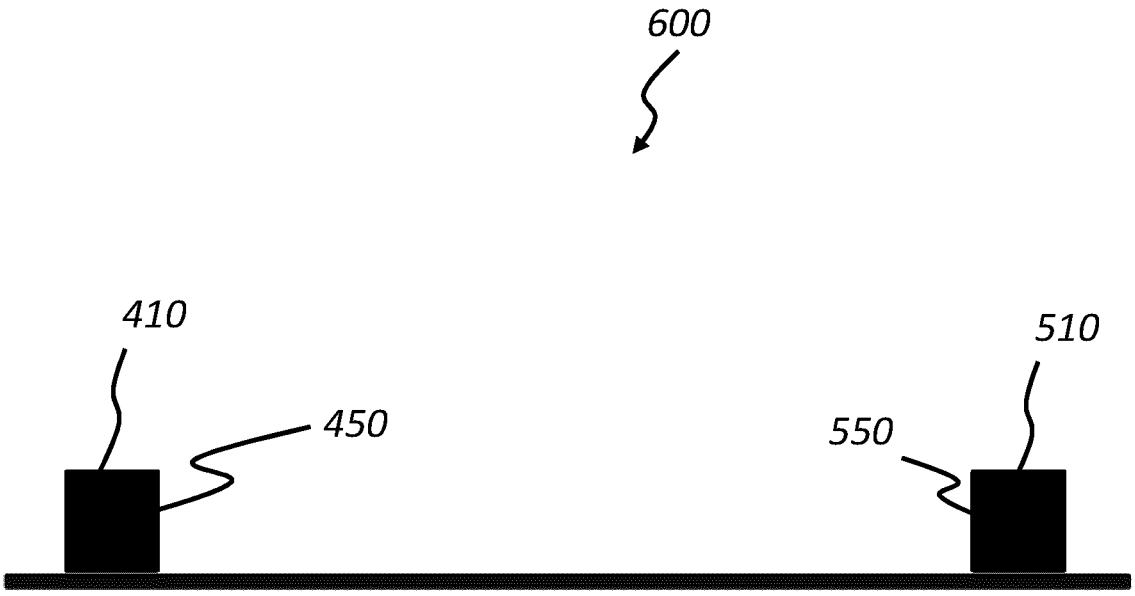
FIG. 6 shows a schematic view of a part of a track system in accordance with the disclosure configured for bottom support running.

Turning to the track system, there may be sections of left cantilever track as shown schematically in FIG. 4, sections of right cantilever track as shown schematically in FIG. 5 and sections of bottom support as shown schematically in FIG. 6.

Referring to FIG. 4, in left cantilever track sections 400, the track system comprises a left support structure 480 comprising the left upper guide surface 430, the left lower running surface 410 and the left lower guide surface 450.

Referring to FIG. 5, in right cantilever track sections 500, the track system comprises a right support structure 580 comprising the right upper guide surface 530, the right lower running surface 510 and the right lower guide surface 550.

Referring to FIG. 6, in bottom support track sections 600, the track system comprises the left lower running surface 410, the left lower guide surface 450, the right lower running surface 510 and the right lower guide surface 550.

There may be junctions in the track where the track transitions from bottom support (for third mode running) to either left cantilever support (first mode running) or right cantilever support (right mode running).

Such junctions may provide for both the left upper guide surface 430 and the right upper guide surface 530 in the approach to the junction in addition to both the left lower running surface 410 and the right lower running surface 510.

Prior to the introduction of the left upper guide surface 430 and the right upper guide surface 530, route selection is determined by selection of one (but not both) of the left upper cantilever wheel assembly 230 (for left route selection) or the right upper cantilever wheel assembly 330 (or right route selection).

Figure 7:
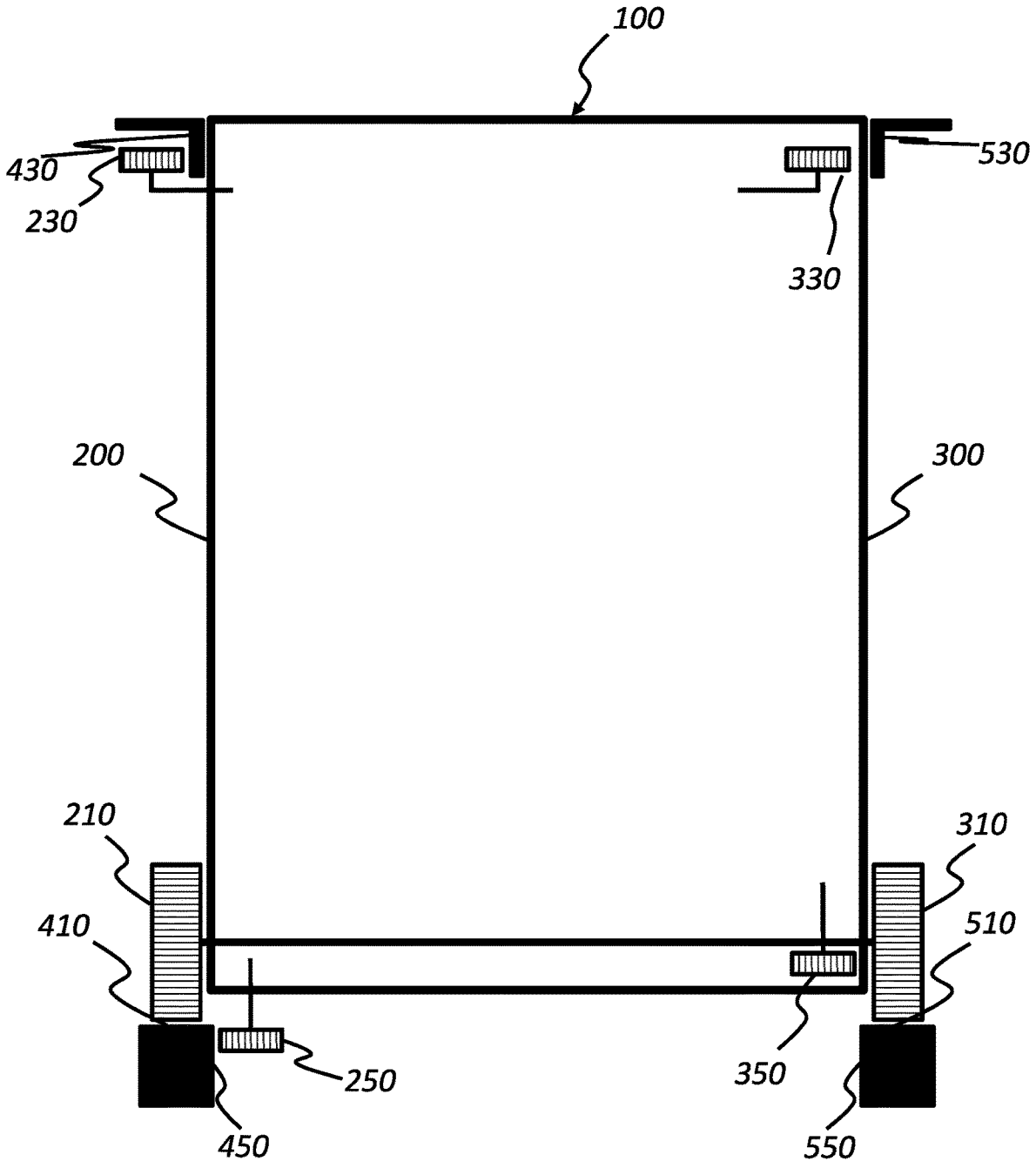
FIG. 7 shows a schematic view of the vehicle of FIGS. 1 to 3 when transitioning from bottom support at a junction where both left and right cantilever support route options are available and showing the configuration of wheel deployments for left route selection.

FIG. 7 shows the configuration of wheel deployment for a left turn at such a junction.

More specifically, FIG. 7 shows the vehicle in situ on the track assembly in the approach to the junction at a point where both left and right upper guide surfaces 430, 530 are in place. Prior to the start of the left and right upper guide surfaces 430, 530, the left upper cantilever wheel assembly 230 has been engaged but not the right upper cantilever wheel assembly 330 such that, at the start of the left upper guide surface 430, the left upper cantilever wheel assembly 230 bears against the left upper guide surface 430. Then, once cantilever support is in place from both the left upper cantilever wheel assembly 230 and the left lower cantilever wheel assembly 250, the right lower cantilever wheel assembly 350 is retracted (so as to adopt the position shown in FIG. 7). In this way, as the left and right upper guide surfaces 430, 530 diverge at the junction, the vehicle cantilevers from the left upper guide surface 430 and the left lower guide surface 450 and thereby follows the left route option at the junction.

Figure 8:
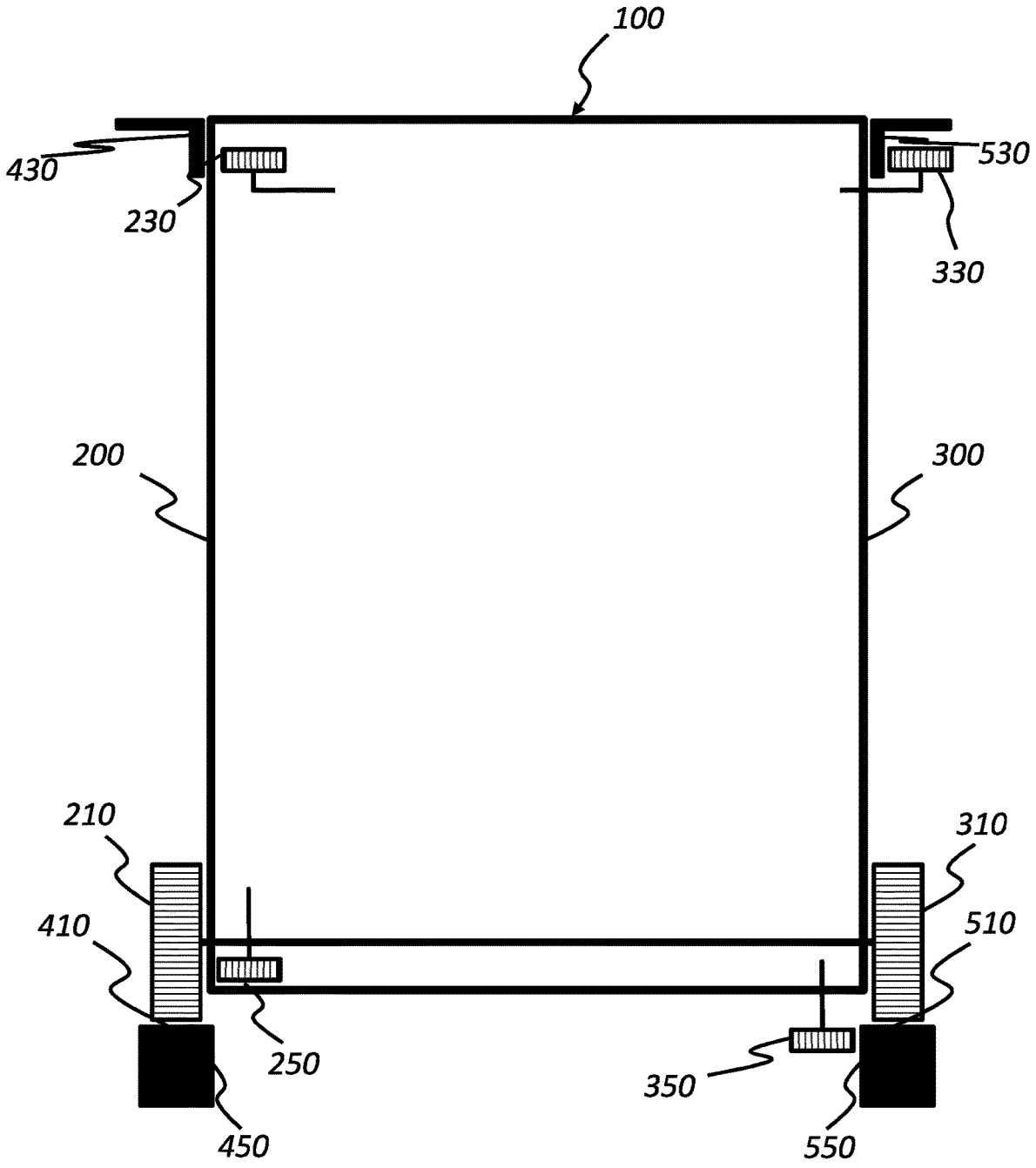
FIG. 8 shows the same vehicle and junction as FIG. 7 but with the configuration of wheel deployments for right route selection.

FIG. 8 shows the configuration of wheel deployment for a right turn at such a junction.

FIG. 8 shows the vehicle in situ on the track assembly in the approach to the junction at a point where both left and right upper guide surfaces 430, 530 are in place—that is exactly the same location as FIG. 7, but with wheel selection for right route selection. Prior to the start of the left and right upper guide surfaces 430, 530, the right upper cantilever wheel assembly 330 has been engaged but not the left upper cantilever wheel assembly 230 such, at the start of the right upper guide surface 530, the right upper cantilever wheel assembly 330 bears against the right upper guide surface 530. Then, once cantilever support is in place from both the right upper cantilever wheel assembly 330 and the right lower cantilever wheel assembly 350, the left lower cantilever wheel assembly 250 is retracted (so as to adopt the position shown in FIG. 8). In this way, as the left and right upper guide surfaces 430, 530 diverge at the junction, the vehicle cantilevers from the right upper guide surface 530 and the right lower guide surface 550 and thereby follows the right route option at the junction.

Figure 9:
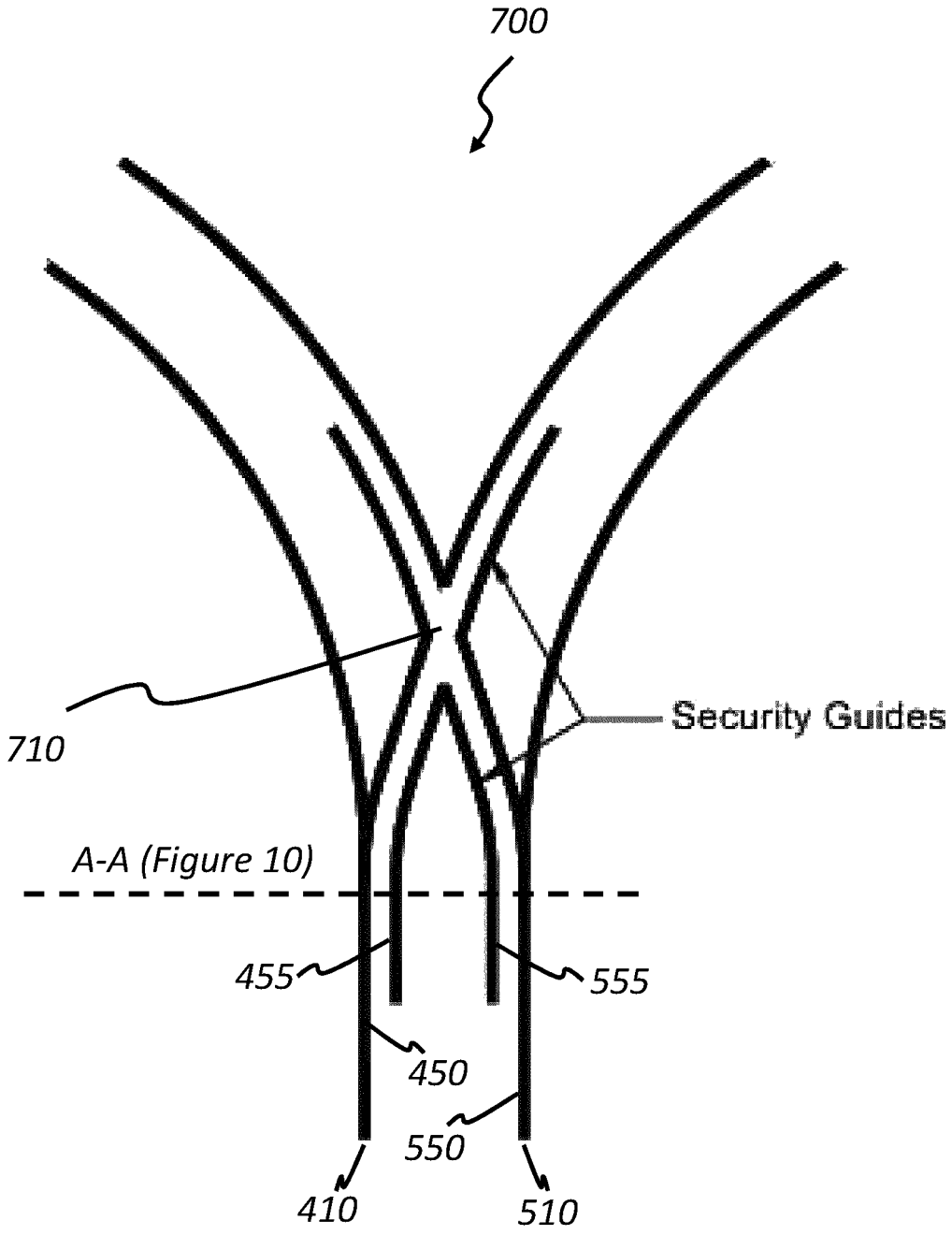
FIG. 9 shows a schematic plan view of a part of a track system in accordance with the disclosure on approach to and through a bottom support junction (with no cantilever operation on either side of the junction)
Figure 10:
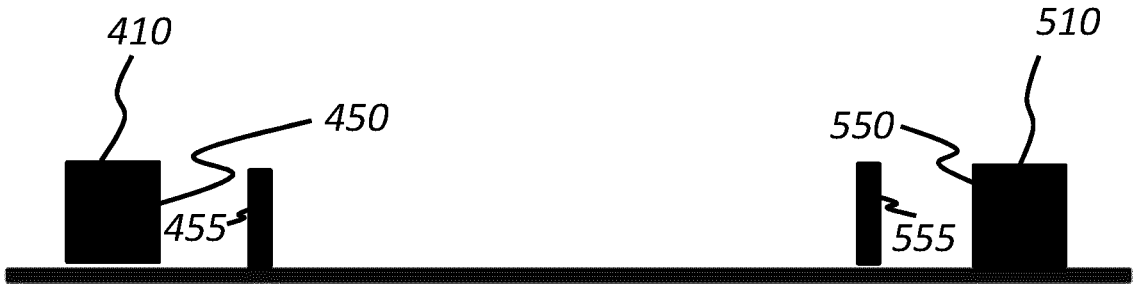
FIG. 10 shows a schematic view of a part of a track system in accordance with the disclosure on approach to a junction, at section A-A identified in FIG. 9.

A different type of junction is shown in FIGS. 9 and 10, specifically a junction 700 that employs only first mode (bottom support) operation on both sides of the junction. FIG. 9 shows a plan view while FIG. 10 shows a view equivalent to that shown in FIGS. 4, 5 and 6.

In the vicinity of the junction 700, the track system may comprise a left security guide surface 455 parallel to the left lower guide surface 450. Similarly, the track system may also comprise a right security guide surface 555 parallel to the right lower guide surface 550.

The purpose of the left security guide surface 455 and the right security guide surface 555 may be to provide a correctional bearing surface for contact by one of the left and right lower cantilever wheel assemblies 250, 350 should the vehicle begin to deviate from the selected path.

Importantly, as evident from FIG. 9, there is a break in the intersecting lower guide surfaces at the point of intersection 710 in order to facilitate passage of the lower guide wheels on the side of the vehicle opposite to the side to which the vehicle is tuning.

The section A-A identified in FIG. 9 is illustrated in FIG. 10. This illustrates the locations of the left security guide surface 455 and the right security guide surface 555 in particular, on the approach to the junction 700.

As already discussed, in anticipation of a junction, route selection by the vehicle 100 is effected by appropriate deployment and retraction of particular guide wheels.

Figure 11:
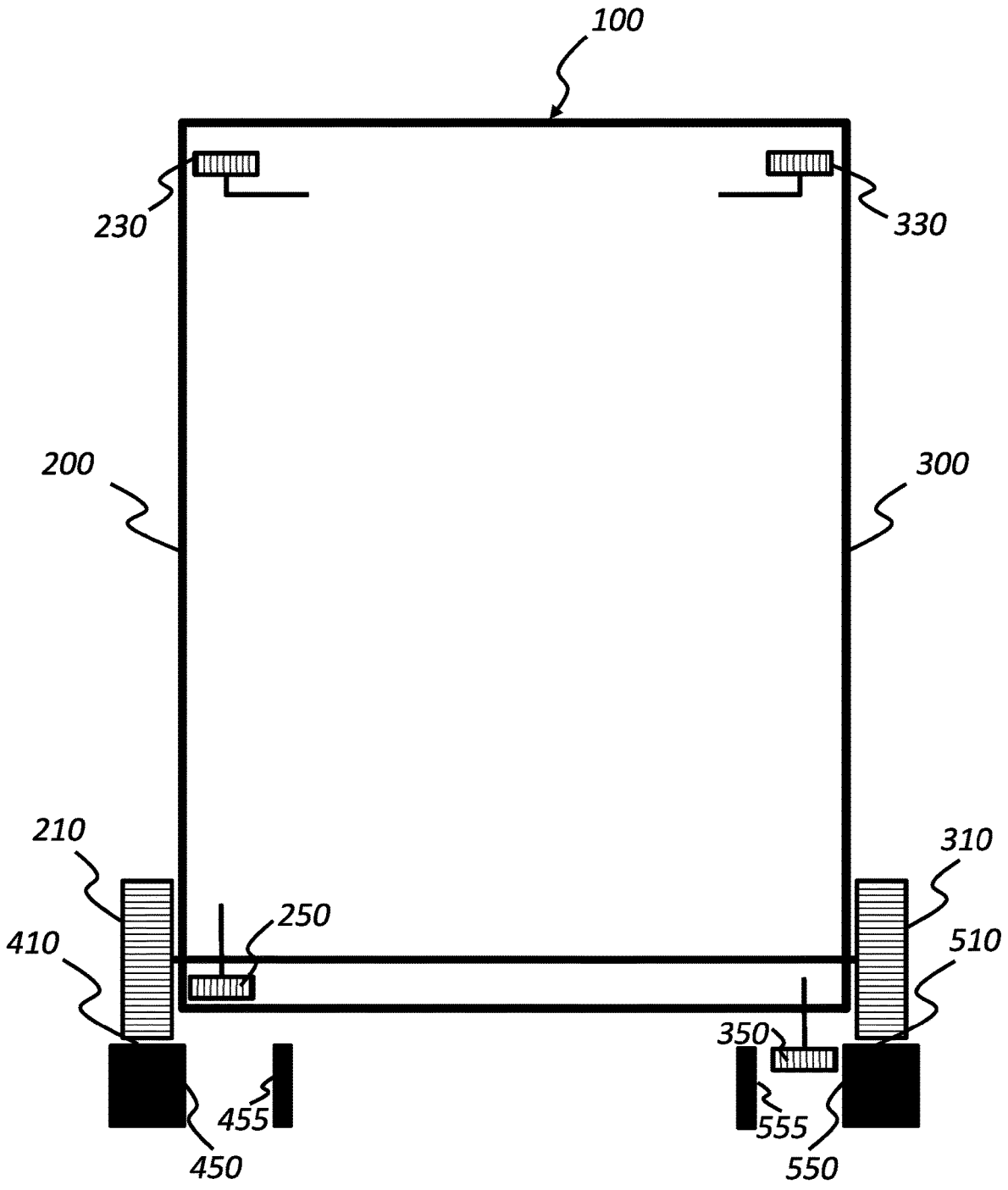
FIG. 11 shows the configuration of wheel deployments for left route selection on approach to the bottom support junction of FIGS. 7 and 8.

For the junction shown in FIGS. 9 and 10, vehicle wheel deployment for left route selection is illustrated in FIG. 11. As shown, the right lower cantilever wheel assembly 350 is in the engaged (deployed) position; all other guide wheel assemblies are in the retracted (disengaged) position.

In this way, the right lower cantilever wheel 353 of the right lower cantilever wheel assembly 350 sits between the right lower guide surface 550 and the right security guide surface 555 and bears against the right lower guide surface 550 thus acting to guide the vehicle along the left route option.

Figure 12:
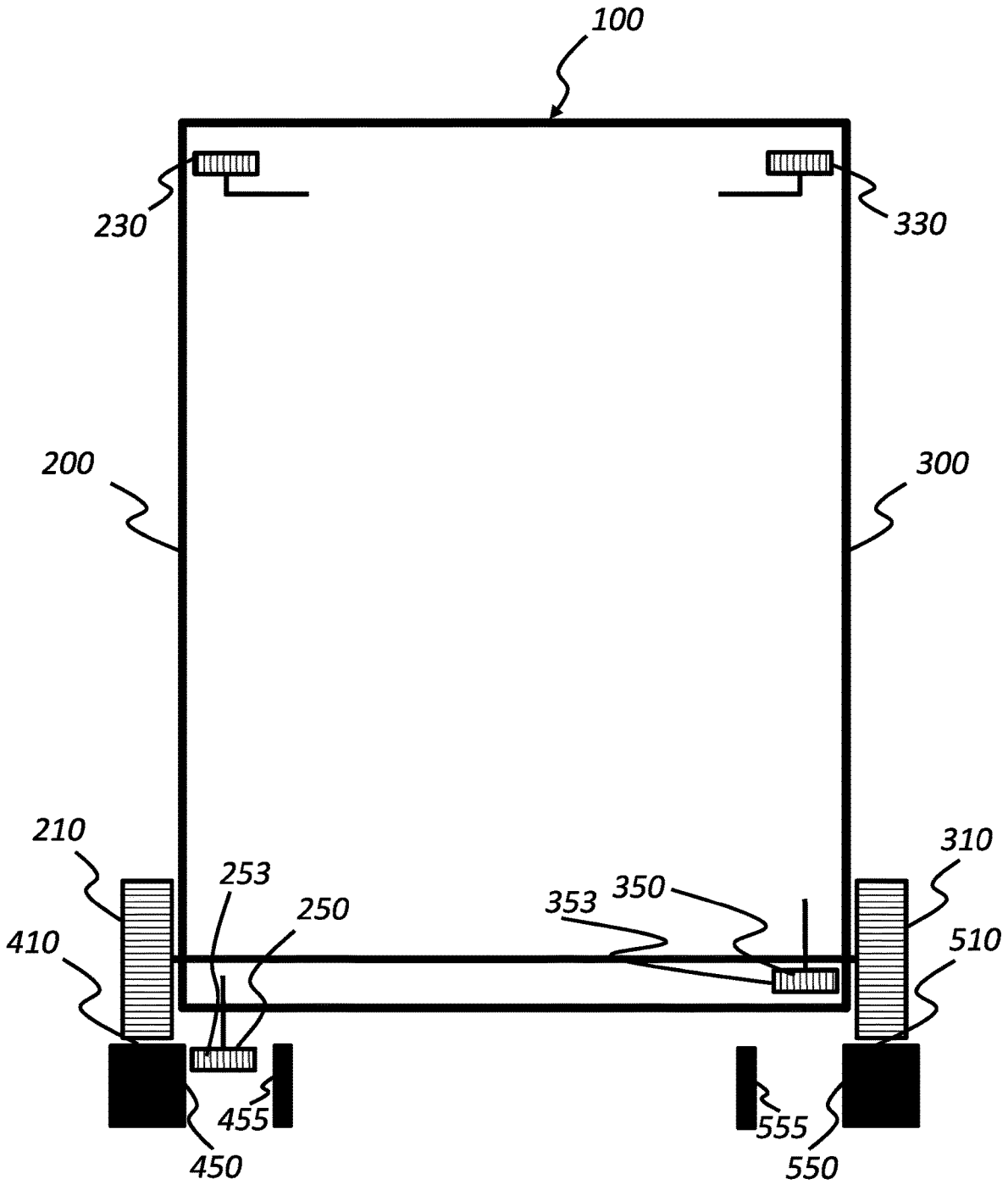
FIG. 12 shows the configuration of wheel deployments for right route selection on approach to the bottom support junction of FIGS. 7 and 8.

For the junction shown in FIGS. 9 and 10, vehicle wheel deployment for right route selection is illustrated in FIG. 12. As shown, the left lower cantilever wheel assembly 250 is in the engaged (deployed) position; all other guide wheel assemblies are in the retracted (disengaged) position.

In this way, the left lower cantilever wheel 253 of the left lower cantilever wheel assembly 250 sits between the left lower guide surface 450 and the left security guide surface 455. The left lower cantilever wheel 253 bears against the left lower guide surface 450 and bears against the left security guide surface 455 thus acting to guide the vehicle along the right route option.

A tapered or angled section may be present at a first end of one or more of the first upper guide surface; the first upper guide surface; the first lower guide surface; and the second lower guide surface to facilitate gentle transition between running modes.

The entry and exit surfaces may also be arranged to be of low-frictional material to minimise skidding shock as the guide wheels initially engage with the entry or exit guide surfaces.

Figure 13:
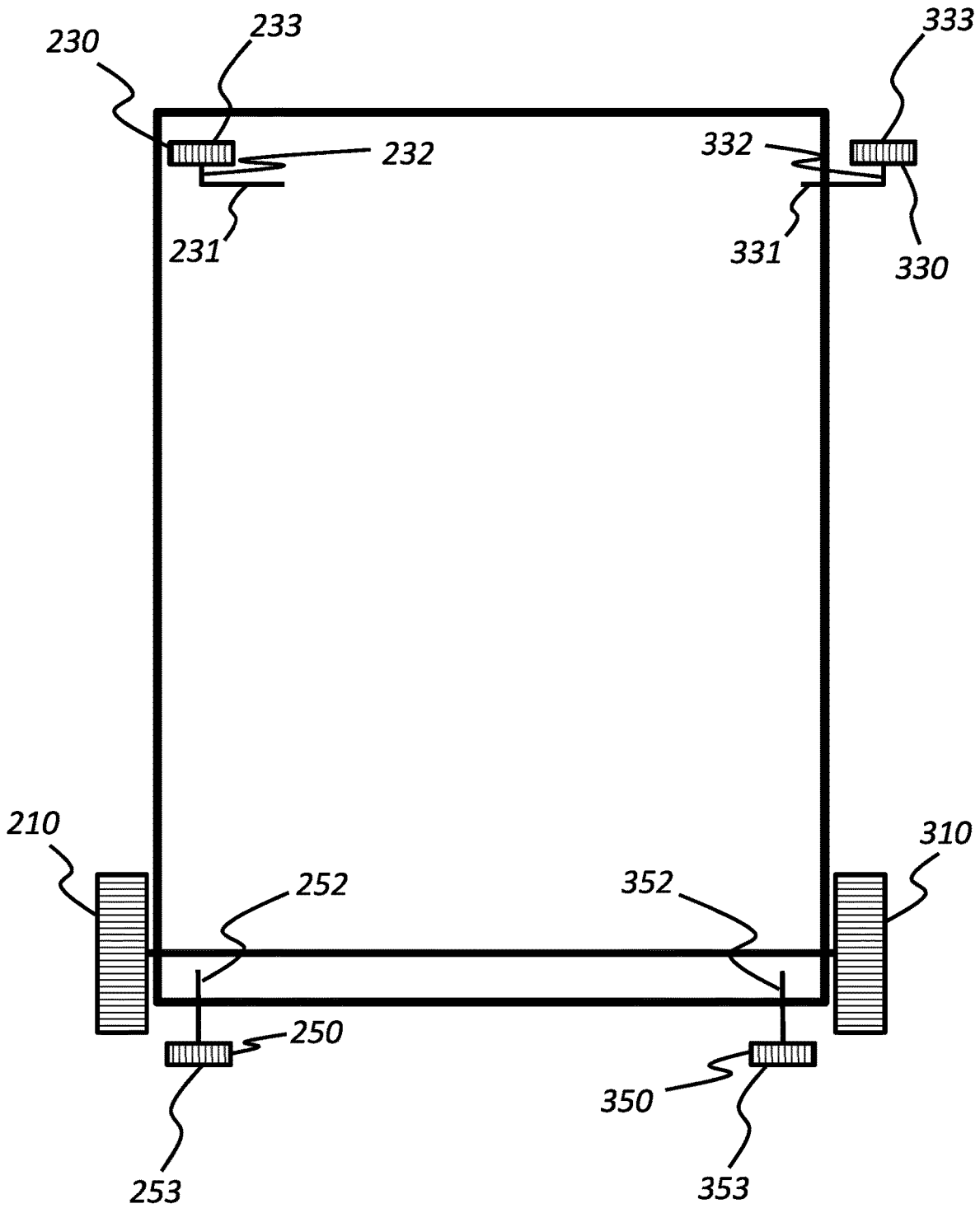
FIG. 13 shows a vehicle in accordance with FIGS. 1 to 3 and identifies more of the details of the wheel assemblies with the addition of further reference numerals.

FIG. 13 focuses on the wheel assemblies and their components. FIG. 13 shows a vehicle with wheel deployment when in right cantilever (second mode) operation.

The left and right upper cantilever wheel assemblies each comprise a lateral arm 231, 331, a vertical axle 232, 332 and a wheel 233, 333 mounted on the vertical axle 232, 332. Each wheel 233, 333 rotates in a substantially horizontal plane.

The left and right lower cantilever wheel assemblies 250, 350 each comprise a vertical axle 252, 352 and a wheel 253, 353 rotatably mounted on the vertical axle 252, 352. Each wheel 253, 353 rotates in a substantially horizontal plane.

As already explained, each of the left upper cantilever wheel assembly 230, the right upper cantilever wheel assembly 330, the left lower cantilever wheel assembly 250 and the right lower cantilever wheel assembly 350 has an engaged (deployed) position and a retracted (disengaged) position. A variety of different mechanisms are envisaged for deployment and retraction.

First, considering first the left and right upper cantilever wheel assemblies 230, 330, in some embodiments, such as the illustrated embodiments, the left and right upper cantilever wheel assemblies 230, 330 (that is the entire wheel assembly rather than just the wheel) may translate laterally between deployed and retracted positions. This lateral movement may be substantially horizontal.

In other embodiments (not illustrated) the left and right upper cantilever wheel assemblies 230, 330 may translate up or down between deployed and retracted positions. This translational movement may be substantially vertical.

In still other embodiments (not illustrated), the left and right upper cantilever wheel assemblies 230, 330 may rotate between deployed and retracted positions.

Secondly, considering the left and right lower cantilever wheel assemblies 250, 350, in some embodiments, such as the illustrated embodiment, the left and right lower cantilever wheel assemblies 250, 350 (that is the entire wheel assembly rather than just the wheel) may translate up or down between deployed and retracted positions. This translational movement may be substantially vertical.

In other embodiments, the left and right lower cantilever wheel assemblies 250, 350 may translate laterally between deployed and retracted positions. This lateral movement may be substantially horizontal.

In still other embodiments (not illustrated), the left and right lower cantilever wheel assemblies 250, 350 may rotate between deployed and retracted positions.

The vehicle 100 may comprise one or more of the following: a left upper housing or slot configured to receive the left upper cantilever wheel assembly in its retracted position; an right upper housing or slot configured to receive the right upper cantilever wheel assembly in its retracted position; a left lower housing or slot configured to receive the left lower cantilever wheel assembly in its retracted position; a right lower housing or slot configured to receive the right lower cantilever wheel assembly in its retracted position.

There may be one housing for each wheel assembly.

Engagement and retraction of any of the wheel assemblies may be effected by any one or more of: hydraulics, pneumatics, linear electric motors, and geared actuator systems.

The lower support wheels may comprise a hub motor powered independently of one or more of the others.

Each vehicle may comprise a first link at either end of the vehicle for selective engagement to and disengagement from an adjacent vehicle. The first link may be mechanical or electronic. The first link may be actuatable remotely. The first link may be a virtual link whereby adjacent vehicles are "linked" by virtue of control meaning that they operate as a platoon even where there may be no mechanical connection between the adjacent vehicles.

The vehicle may comprise one or more photovoltaic panels. One or more photovoltaic panels may be located on the upper surface of the vehicle.

The vehicle may be equipped with an inflatable emergency escape slide deployable in case of emergency.

The disclosure also contemplates a foundation for a pillar configured to support one or more of a left and right lower support tracks; left and right lower guide surfaces; and left and right upper guide surfaces; the foundations comprising: a drilled hole and bas pad fitted with a pre-fabricated tubular socket. The socket may optionally comprise an internal thread for receiving the pillar.

The disclosure further includes a pillar configured to support one or more of a left and right lower support tracks; left and right lower guide surfaces; and left and right upper guide surfaces. The pillar may comprise an external thread for releasable engagement with the foundation.

The track system may further comprise means for adapting an angular position of the pillar relative to the foundations.

The pillar may comprise a stem and a disengable sealing cap, wherein the sealing cap comprises supports for the one or more of a left and right lower support tracks; left and right lower guide surfaces; and left and right upper guide surfaces.

The track system may be fitted with one or multiple photovoltaic panels.

The track system may be equipped with comprise inflatable emergency escape slides that may be deployed for escape from height, or be deployed as a raft, or both.

The disclosure further includes a control system configured to control deployment and retraction of support wheels dependent upon vehicle routing instructions. The vehicle routing instructions may be provided in advance or in real time, for example to deploy vehicles to meet demand. The control system comprises a local vehicle element and may or may not include a remote element, for example provided by a central control centre.

Given that such vehicles may be used in a variety of circumstances, for example, simple airport links or complex city networks, or hot or cold climates, detailed vehicle size, design and fit-out may vary. The fundamental control system, embodied in software and hardware, can conveniently be packaged in a 'black box' or equivalent that could be offered to independent licensed vehicle builders in different countries and jurisdictions.

Using the extendable/retractable guide wheels in combination with the bottom and side modes of operation, junctions requiring essentially no load-bearing moving parts on the track can be arranged. Track selection by the vehicle, or cohorts of vehicles, can provide many operational advantages.

Another desirable feature of vehicles that can operate on both bottom support and side support modes is the ability to power or apply brakes to any of the lower running wheels independently. When operating on bottom support, a pair of lower running wheels, left and right, can be powered to drive the vehicle; alternatively all lower running wheels can be powered to drive the vehicle on bottom support. However, when operating on side support, one or all of the running wheels on the selected supported side are powered, the running wheels on the other side preferably not powered.

Using in-hub electrically powered traction motors in all the running wheels, selectively operated by a central control system on the vehicle, and such vehicle central control system itself linked to, and controlled by the control and the transit system control arrangements, brings a number of benefits that include potential simplicity of design, with potential weight reduction and increased useful space, some energy saving and, on side support, the reduction of any undesirable water spray or dirt thrown off the idle wheels if powered.

A further desirable feature of vehicles that can operate on both bottom and side support in cohorts is the ability for the cohorts to dis-aggregate into smaller cohorts of vehicles or even individual vehicles, while moving or stationary, under automated control. Vehicles are operated in cohorts In order to provide a desired rider capacity. The capacity of each vehicle, the number in the cohort and the frequency of the cohorts determines the rider capacity per hour in a transit system.

Typically a city transit system will require relatively high capacity in the downtown area and will need less capacity as the cohorts travel further and further into the suburbs and beyond. High capacity requires long cohorts and costly long stations. Operating long cohorts in low demand sectors is costly and wasteful. By aggregating or disaggregating vehicles as they travel between high and low demand sectors, a transit system can provide seamless high frequency services through the system, without incurring excessive capital costs in the outer lower demand sectors. For example a 4-vehicle N-bound cohort could split into two 2-vehicle cohorts, one to the NW and the other to the NE.

By providing software controlled links between vehicles that operate seamlessly on both bottom support and side support modes, such vehicles can be operated in long cohorts, in cohorts consisting of cohorts of smaller or larger numbers vehicles, and individually. The links can be mechanical, engaging or disengaging electrically or by other means as controlled electronically by the software.

Alternatively, the link can be electronic with suitable proximity and other sensors communicating to the vehicle control system to adjust the speed of the vehicle to the speed of the adjacent vehicles and to maintain contact or a desired separation Such separation may be fixed within operational parameters, for example 10-5000 cm, or may be varied depending on the position of the vehicle in the cohort and the overall speed of the cohort. For example it may prove advantageous to adjust the speeds of the first and last vehicles in the cohort such that the vehicles in the cohort remains coherent and close; on the other hand, for operational and safety purposes it may prove advantageous to increase the separation as the cohort speed increase or if a particular cohort or vehicle is about to be disaggregated from the cohort.

Given that such vehicles may be used in a variety of circumstances, for example, simple airport links or complex city networks, or hot or cold climates, detailed vehicle size, design and fit-out may vary. The fundamental control system, embodied in software and hardware, can conveniently be packaged in a 'black box' or equivalent, that could be offered to independent licensed vehicle builders in different countries and jurisdictions.

An advantage offered by vehicles, capable of running on ground level tracks at grade or in tunnel, and also cantilevered is that the elevated structure can be of relatively light construction, more on the scale a sturdy footbridge than a traditional railway viaduct. Typically elevated guidance structures will be mounted on pillars of reinforced concrete, steel or other strong material, partly sunk into a foundation hole. Preferably the pillars are light enough to be manufactured off-site, for installation on-site.

By drilling a hole for the foundation of the pillar, inserting a base tablet at a desired depth to control the depth of insertion of the pillar, inserting a pre-fabricated tubular socket of a rigid material such as concrete or steel, rough on the exterior to provide an anchor to the surrounding ground, optionally securing the tubular socket in place with concrete between the tube and the surrounding ground, such pre-fabricated socket provided with an internal screw-like female thread, so that a pillar provided with a bolt or screw-like male thread can be bolted or screwed into the prepared socket, and locked into angular position with a suitable pin. Such a pre-fabricated pillar could, if required, be extracted and repositioned should the alignment of the guideway need to be adjusted or extended.

The pillar can also be provided with a bolt or screw-like thread at the top so that a sealing cap, optionally fitted with support members for the guideway, can be screwed on, facilitating installation on-site, and also removable and repositionable if required. Installation of pre-fabricated components offers the advantages of faster erection, lower costs and reduced local disruption, compared with building a much larger viaduct on-site for conventional light rail transit.

All such vehicles and guideways can have part or all of their upper surfaces covered with photo-voltaic panels to collect solar energy for use within the system or for exterior sale.

Such vehicles and guideways can be fitted with inflatable emergency escape slides similar to those fitted to passenger aeroplanes, as a means of escape from elevated track or vehicles, supplementary to walkways and stairs. Where the elevated structure passes over water, the slide can be arranged to also act as a raft.

The invention claimed is:

1. A vehicle configured to operate in a first mode in a cantilevered manner from a left side of the vehicle; in a second mode in a cantilevered manner from a right side of the vehicle; and in a third mode in which the vehicle is supported from beneath in a non-cantilevered manner, the vehicle comprising:

a left lower support wheel on the left side of the vehicle configured to engage with a left lower running surface beneath the left lower support wheel for supporting the vehicle from beneath;

a right lower support wheel on the right side of the vehicle configured to engage with a right lower running surface beneath the right lower support wheel for supporting the vehicle from beneath;

a left upper cantilever wheel assembly on the left side of the vehicle having: an engaged position wherein it is configured to bear against a left upper guide surface located proximate the left side of the vehicle; and a retracted position for disengagement from the left upper guide surface;

a right upper cantilever wheel assembly on the right side of the vehicle having: an engaged position wherein it is configured to bear against a right upper guide surface located proximate the right side of the vehicle; and a retracted position for disengagement from the right upper guide surface;

a left lower cantilever wheel assembly on the left side of the vehicle having: an engaged position wherein it is configured to bear against a left lower guide surface located proximate the left side of the vehicle; and a retracted position for disengagement from the left lower guide surface;

a right lower cantilever wheel assembly on the right side of the vehicle having: an engaged position wherein it is configured to bear against a right lower guide surface located proximate the right side of the vehicle; and a retracted position for disengagement from the right lower guide surface;

wherein the left and right lower cantilever wheel assemblies translate substantially vertically between deployed and retracted positions;

wherein the left and right upper cantilever wheel assemblies translate substantially horizontally between deployed and retracted positions;

wherein on operation of the vehicle in the first mode: the left lower support wheel is configured to engage with the left lower running surface; the left upper cantilever wheel assembly is in its engaged position; and the left lower cantilever wheel assembly is in its engaged position; and the right lower support wheel is unengaged from any running surface;

wherein on operation of the vehicle in the second mode: the right lower support wheel is configured to engage with the right lower running surface; the right upper cantilever wheel assembly is in its engaged position; and the right lower cantilever wheel assembly is in its engaged position; and the left lower support wheel is unengaged from any running surface;

wherein on operation of the vehicle in the third mode: the left lower support wheel is configured to engage with the left lower running surface; the right lower support wheel is configured to engage with the right lower running surface; the left lower cantilever wheel assembly is in its engaged position; and the right lower cantilever wheel assembly is in its engaged position;

whereby, in the third mode, at a junction providing both first and second mode route options, selection between a left route option having a left upper guide surface and a right route option having a right upper guide surface is effected:

for left route selection, by adopting: the engaged position of the left upper cantilever wheel assembly; the engaged position of the left lower cantilever wheel assembly; the disengaged position of the right upper cantilever wheel assembly; and for right route selection, by adopting: the engaged position of the right upper cantilever wheel assembly; the engaged position of the right lower cantilever wheel assembly; the disengaged position of the left upper cantilever wheel assembly.

2. The vehicle of claim 1 wherein, in the third mode, at a junction providing both a left route third mode option and a right route third mode option, selection between the left route option and the right route option is effected:

for left route selection by adopting: the engaged position of the right lower cantilever wheel assembly; and the disengaged position of the left lower cantilever wheel assembly; and for right route selection by adopting: the engaged position of the left lower cantilever wheel assembly; and the disengaged position of the right lower cantilever wheel assembly.

3. The vehicle of claim 1, wherein each of the left and right upper cantilever wheel assemblies comprises an upper cantilever wheel and a retractable lateral member, wherein the upper cantilever wheel is mounted on its retractable lateral member and is rotatable in an essentially lateral plane parallel to its lateral member.

4. The vehicle of claim 1 wherein each upper cantilever wheel assembly comprises an upper cantilever wheel and a retractable vertical member, wherein the upper cantilever wheel is mounted on the retractable vertical member and is rotatable in a lateral plane.

5. The vehicle of claim 1, wherein:

the left lower support wheel comprises a wheel having a substantially vertical orientation and configured to rotate about a first substantially horizontal axis; and the right lower support wheel comprises a wheel having a substantially vertical orientation and configured to rotate about a second substantially horizontal axis.

6. The vehicle of claim 1, wherein:

the left upper cantilever wheel assembly comprises a wheel having a substantially horizontal orientation and configured to rotate about a first substantially vertical axis; and the right upper cantilever wheel assembly comprises a wheel having a substantially horizontal orientation and configured to rotate about a second substantially vertical axis.

7. The vehicle of claim 1, further comprising:

multiple upper cantilever wheel assemblies on the left side of the vehicle;

multiple upper cantilever wheel assemblies on the right side of the vehicle.

8. The vehicle of claim 1, wherein the vehicle further comprises:

one or more left housings or slots configured to receive the corresponding one or more left upper cantilever wheel assemblies in its retracted position;

one or more right housings or slots configured to receive the corresponding one or more right upper cantilever wheel assemblies in its retracted position.

9. The vehicle of claim 1, wherein engagement and retraction of one or more of the left upper cantilever wheel assembly, the right upper cantilever wheel assembly, the left lower cantilever wheel assembly and the right lower cantilever wheel assembly is effected by one or more of: hydraulics, pneumatics, linear electric motors, and geared actuator systems.

10. The vehicle of claim 1, wherein one or more of the left lower support wheel, the right lower support wheel comprises a hub motor powered independently of one or more of the others.

11. The vehicle of claim 1, further comprising a first link at either end of the vehicle for selective engagement to and disengagement from an adjacent vehicle.

12. The vehicle of claim 1, further comprising one or more photovoltaic panels and/or one or more inflatable emergency escape slides deployable in case of emergency.

13. The vehicle of claim 1, configured to operate in a platoon with one or more other said vehicles, wherein the vehicles in the platoon are configured to travel in the platoon as determined, optionally variable, intervals between 0 cm and 5 m and to aggregate and disaggregate on the track system.

14. The track system for a vehicle of claim 1, the track system comprising:

a first type of junction section;

a second type of junction section;

a left lower support track configured to support the left lower support wheel on the left side of the vehicle;

a right lower support track configured to support the right lower support wheel on the right side of the vehicle;

a left upper guide surface configured for the left upper cantilever wheel assembly to bear against;

a right upper guide surface configured for the right upper cantilever wheel assembly to bear against;

a left lower guide surface configured for the left lower cantilever wheel to bear against;

a right lower guide surface configured for the right lower cantilever wheel to bear against;

wherein the track system further comprises:

a left side cantilever section that includes the left lower support track, the left lower guide surface and the left upper guide surface;

a right side cantilever section that includes the right lower support track, the right lower guide surface and the right upper guide surface;

wherein the first type of junction section includes:

the left and right lower support tracks;

an entry portion of the left upper guide surface;

an entry portion of the right upper guide surface;

such that:

in an event that left route selection is effected by the vehicle, the left upper cantilever wheel assembly engages with the left upper guide surface and left lower cantilever wheel assembly engages with the left lower guide surface;

in an event that right route selection is effected by the vehicle, the right upper cantilever wheel assembly engages with the right upper guide surface and the right lower cantilever wheel assembly engages with the right lower guide surface; and wherein the second type of junction section includes:

the left and right lower support tracks:

including an approach section;

a left diverging path; and a right diverging path;

and further comprising a gap in the left and right support tracks at a location where the left and right support tracks would otherwise intersect;

such that:

in an event that left route selection is effected by the vehicle, the right lower cantilever wheel engages with the right lower guide surface except in the gap; and in an event that right route selection is effected by the vehicle, left lower cantilever wheel assembly engages with the left lower guide surface except in the gap.

15. The track system of claim 14, wherein:

the left and right lower support tracks are substantially horizontal;

the left and right upper guide surfaces are substantially vertical; and the left and right lower guide surfaces are substantially vertical.

16. The track system according to claim 14, wherein one or more of the following elements:

the first upper guide surface;

the second upper guide surface;

the first lower guide surface;

the second lower guide surface;

comprises:

a tapered or angled section at a first end thereof to facilitate gentle transition between running modes and wherein optionally the tapered or angled section is coated or treated with a low friction coefficient surface.

17. The track system of claim 14, further comprising:

security guides proximate a junction configured to restrict deviation of lower guide wheels proximate the gap in the left and right lower guide surface.

18. A foundation for a pillar configured to support one or more of the left and right lower support tracks; left and right lower guide surfaces; and left and right upper guide surfaces of claim 14; the foundation comprising: a pre-fabricated tubular socket comprising an internal thread for receiving the pillar.

19. The track system of claim 14, comprising a pillar configured to support one or more of a left and right lower support tracks; left and right lower guide surfaces; and left and right upper guide surfaces; the pillar comprising an external thread for releasable engagement with a foundation.

20. The track system of claim 19 wherein the pillar comprises a stem and a disengagable sealing cap, wherein the sealing cap comprises supports for the one or more of a left and right lower support tracks; left and right lower guide surfaces; and left and right upper guide surfaces.

21. The track system of claim 14, further comprising one or more photovoltaic panels and/or one or more inflatable emergency escape slides.

22. A computer-readable medium comprising instructions which, when executed by a computer, cause the computer to instruct the steps of controlling wheel deployment configurations in the vehicle according to claim 1, and any doors or other movable parts.

* * * * *